United States Patent [19]

Yonezawa et al.

[11] Patent Number: 4,710,237

[45] Date of Patent: Dec. 1, 1987

[54] METHOD FOR THERMAL TREATMENT OF NICKEL BASED ALLOY MATERIALS

[75] Inventors: Toshio Yonezawa; Nobuya Sasaguri; Kichiro Onimura; Hiroshi Susukida; Katsuji Kawaguchi, all of Takasago; Hiroo Nagano, Kobeshi; Takao Minami, Amagasakishi; Kazuo Yamanaka, Monooshi; Yasutaka Okada, Narashi; Mamoru Inoue, Kobeshi, all of Japan

[73] Assignees: Mitsubishi Jukogyo Kabushiki Kaisha, Tokyo; Sumitomo Metal Industries, Ltd., Osaka, both of Japan

[21] Appl. No.: 815,774

[22] Filed: Jan. 2, 1986

Related U.S. Application Data

[63] Continuation of Ser. No. 550,024, Nov. 8, 1983, abandoned.

[30] Foreign Application Priority Data

Nov. 10, 1982 [JP] Japan ..... 57-197362

[51] Int. Cl.[4] ..... C22F 1/10

[52] U.S. Cl. ..... 148/13; 148/162

[58] Field of Search ..... 148/162, 13, 410, 427; 420/448

[56] References Cited

U.S. PATENT DOCUMENTS 3,573,901 4/1971 Economy ..... 420/448

OTHER PUBLICATIONS

Nuclear Technology, vol. 55, Nov. 1981, pp. 436–448, article entitled "A Stress Corrosion Cracking Evaluation of Inconel 690 for Steam Generator Tubing Applications", by G. P. Airey et al.

*Primary Examiner*—R. Dean

*Attorney, Agent, or Firm*—Toren, McGeady & Associates

[57] ABSTRACT

A method for a thermal treatment of a nickel based alloy, characterized in that said nickel based alloy for a material which will be subjected to a high-temperature and high-pressure water or vapor comprises, in terms of % by weight, 58% or more of Ni, 25 to 35% of Cr, 0.003% or less of B, 0.012 to 0.035% of C, 1% or less of Mn, 0.5% or less of Si, 0.015% or less of P, 0.015% or less of S, and the residue of Fe and usual impurities; in a first thermal treatment process, said nickel based alloy is heated and retained at a temperature of T° C. to (T+100)°C. and is cooled at a cooling rate of a furnace cooling rate or more; and in a second thermal treatment process, said nickel based alloy is then retained at a temperature of 600° to 750° C. and at a temperature within a sensitization recovery range for a period of 0.1 to 100 hours and is cooled at a cooling rate of said furnace cooling rate or more.

2 Claims, 3 Drawing Figures

METHOD FOR THERMAL TREATMENT OF NICKEL BASED ALLOY MATERIALS

This is a continuation of application Ser. No. 550,024, filed Nov. 8, 1983, abandoned.

FIELD AND BACKGROUND OF THE INVENTION

The present invention relates to a method for a thermal treatment of a non-deposition hardening type nickel based alloy which will be subjected to a high-temperature and high-pressure water or vapor and which has a remarkably improved crystal boundary etching resistance, mechanical properties and pitting corrosion resistance, in addition to the maintenance of a stress corrosion cracking resistance, and further has a bettered stress corrosion resistance in an aqueous NaOH solution.

Heretofore, as materials, for a container for giving off vapor in a nuclear reactor, which will be exposed to the high-temperature and high-pressure water or vapor, for example, at 200° to 400° C. and at 50 to 200 atm, and as materials used under a cooling system environment in a nuclear reactor, there are nickel based alloys such as INCOROI 800 (trade name), and INCONEL 600 (trade name) and INCONEL 690 (trade name) set forth in Table 1 below. In recent years, these alloys have further been treated by heating them at a rather lower temperature than a level (hereinafter referred to as T° C.) at which a carbide is thoroughly solubilized, alternatively by further additionally specifically heating and retaining them at a temperature of 650° to 750° C., in order to improve the crystal boundary etching resistance and stress corrosion cracking resistance.

However, the nickel based alloys which have undergone such a conventional thermal treatment are still poor in the pitting corrosion resistance and stress corrosion cracking resistance.

SUMMARY OF THE INVENTION

In view of the above-mentioned conventional techniques, an object of the present invention is to provide a method for a thermal treatment of a nickel based alloy without such drawbacks above, i.e. a method for a thermal treatment of a nickel based alloy by which its mechanical properties, pitting corrosion resistance, stress corrosion cracking resistance and crystal boundary etching resistance can be improved.

For the aforesaid object, the summary of the present invention is directed to a method for a thermal treatment of a nickel based alloy, characterized in that said nickel based alloy for a material which will be subjected to a high-temperature and high-pressure water or vapor comprises, in terms of % by weight, 58% or more of Ni, 25 to 35% of Cr, 0.003% or less of B, 0.012 to 0.035% of C, 1% or less of Mn, 0.5% or less of Si, 0.015% or less of P, 0.015% or less of S, and the residue of Fe and usual impurities; in a first thermal treatment process, said nickel based alloy is heated and retained at a temperature of T° C. to (T+100)° C. and is cooled at a greater cooling rate than a furnace cooling rate; and in a second thermal treatment process, said nickel based alloy is then retained at a temperature of 600° to 750° C. and a temperature within a sensitization recovery range for a period of 0.1 to 100 hours and is cooled at a greater cooling rate than said furnace cooling rate.

DETAILED DESCRIPTION OF THE INVENTION

Now, reference will be made in detail to an alloy to be treated, a first thermal treatment process and a second thermal treatment process.

Alloy to be treated:

The content of Ni is 58% or more, since when it is below 58%, the alloy will be poor in an alkali stress corrosion cracking resistance.

When the content of Cr is less than 25%, the alloy will have a less crystal boundary etching resistance and stress corrosion cracking resistance; when it is more than 35%, abnormal substances will deposit in the second thermal treatment process, which fact will lead to the deterioration in ductility. Therefore, the content of Cr is within the range of 25 to 35%.

With regard to the element B, when its content is above 0.003%, the alloy will be poor in the crystal boundary etching resistance. Therefore, the content of B is 0.003% or less.

When the content of C is less than 0.012%, the alloy will have an insufficient strength; when it is in excess of 0.035%, it will be poor in the stress corrosion cracking resistance. Therefore, the content of C is within the range of 0.012 to 0.035%.

Elements P, S and the like are incorporated into the product as impurities during a process of a usual iron manufacture or steel manufacture, but too much impurities have bad influence upon the corrosion resistance. Therefore, the content of P is 0.015% or less and that of S is also 0.015% or less.

Further, Mn and Si are added for the sake of a deoxidation, a reinforcement of a matrix and a reinforcement of grain boundaries, but when the content of Mn is more than 1%, the alloy will be hard to melt, and when the content of Si is more than 0.5%, the alloy will be poor in welding properties. Therefore, the content of Mn is 1% or less, and that of Si is limited to 0.5% or less.

Figure 1:
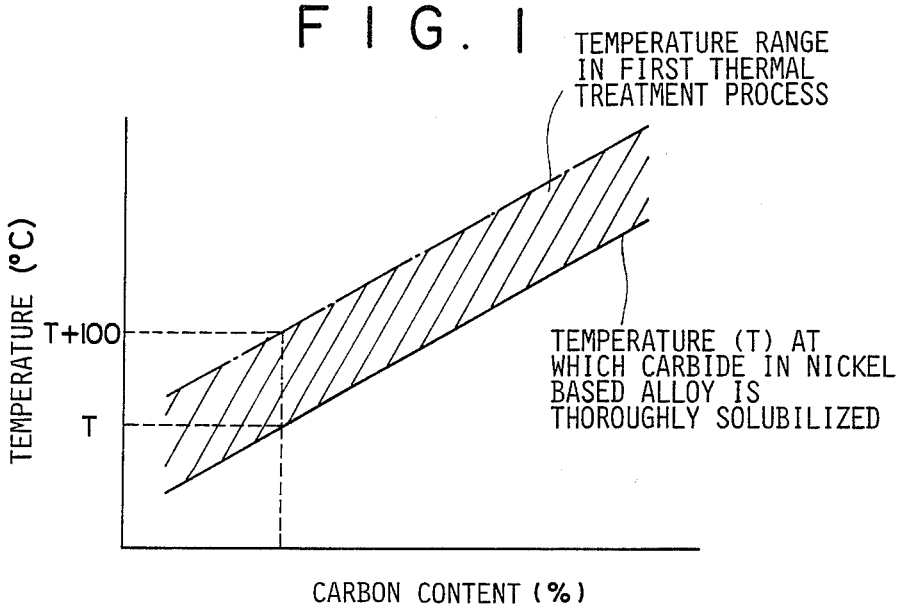
FIG. 1 is a schematic diagram illustrating a solution temperature of a carbide in a nickel based alloy and a temperature range in a first thermal treatment process.

First thermal treatment process:

A temperature T° C. at which the carbide of the nickel based alloy is thoroughly solubilized varies with the content of C, as elucidated by the schematic view in FIG. 1. If this thermal treatment process is carried out at a temperature less than T° C., the carbide will deposit, thereby unreasonably increasing a tensile strength, 0.2% yield point and hardness, and thus deteriorating the stress corrosion cracking resistant. On the contrary, if at a temperature more than (T+100)° C., a grain size of crystals will become remarkably coarse, thereby deteriorating the crystal boundary etching resistance, and merely providing the insufficient tensile strength, 0.2% yield point and hardness.

Further, it is natural that the retention time is prolonged with the increase in the wall thickness of the material, hence it is impossible to uniformly define the retention time. However, generally speaking, the retention time takes 30 minutes or so per 2.54 cm (1 inch) of the material thickness, and in the case that the material thickness is 2.54 cm or less, 1 to 30 minutes will be usually taken. Further, since an abnormally prolonged time will produce coarse crystals on the surface of the material and its strength will thus be lowered, it is preferred that the retention time is within the range of 1 minute to 2 hours.

Then, the alloy is cooled, for example, from a level of 200° C. to room temperature.

With regard to a cooling rate of the alloy, the cooling rate less than a furnace cooling rate is not advantageous, but any rate of the furnace cooling rate or more is in fact satisfactory. The cooling rate of the furnace cooling rate or more can be obtained by, for example, the furnace cooling, an air cooling, gas cooling, oil cooling, water cooling and the like.

Figure 2:
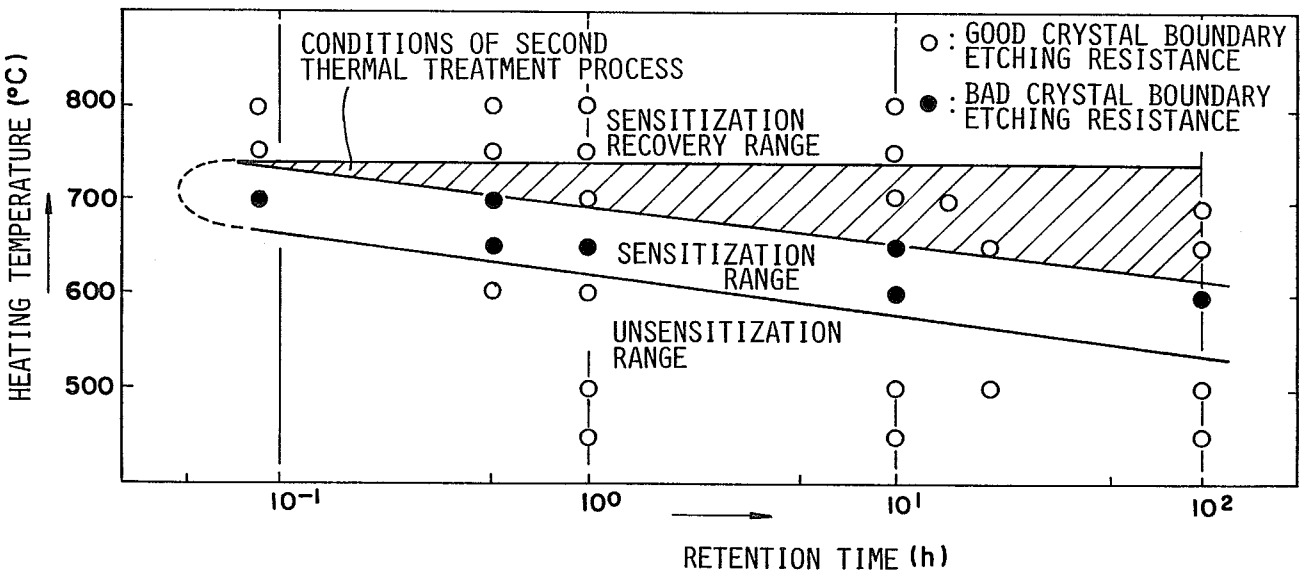
FIG. 2 is a diagram illustrating an influence of conditions of a second thermal treatment process regarding the present invention upon a crystal boundary etching resistance.

Second thermal treatment process:

After retained at a temperature of T° C. to (T+100)° C. for a period of 30 minutes and water cooled in the first thermal treatment process, specimens of Table 2 below were retained at various heating temperatures for various periods of time and were cooled in the same manner as in the aforesaid first process. Then, they were immersed in a boiling solution of 65% $HNO_3$ and 0.1-N HF for a period of 4 hours. Obtained test results are shown in FIG. 2 below. In a sensitization range in FIG. 2, Cr-free layers are formed on crystal boundaries, and a crystal boundary etching and pitting corrosion thus tend to occur. Further, in the case of the alloys in an unsensitization range therein, there is a probability of their being sensitized during their use as the real materials at a high temperature, therefore they are also liable to bring about the crystal boundary etching. In consequence, the retention temperature in the second thermal treatment process must be in a sensitization recovery range in which the Cr-free layers recover. Furthermore, when the retention temperature is more than 750° C., a solubility of C will be great and a solubility difference will result from a temperature difference between such a temperature and a temperature at the time of a cooling or a practical use. As a result, a carbide tends to deposit on the crystal boundaries. When the retention temperature is less than 600° C., the retention time more than 100 hours will be required, which fact is not economical. Therefore, the retention temperature is limited to the range of 600° to 750° C. Moreover, when the retention time is less than $10^{-1}$ hour, the sensitization recovery range cannot be prepared at the aforesaid temperature; the retention time more than 100 hours is not economical. Therefore, it should be within the range of $10^{-1}$ to 100 hours. With regard to the cooling rate in this case, any rate of the furnace cooling rate or more is satisfactory, as in the first thermal treatment process.

Figure 3:
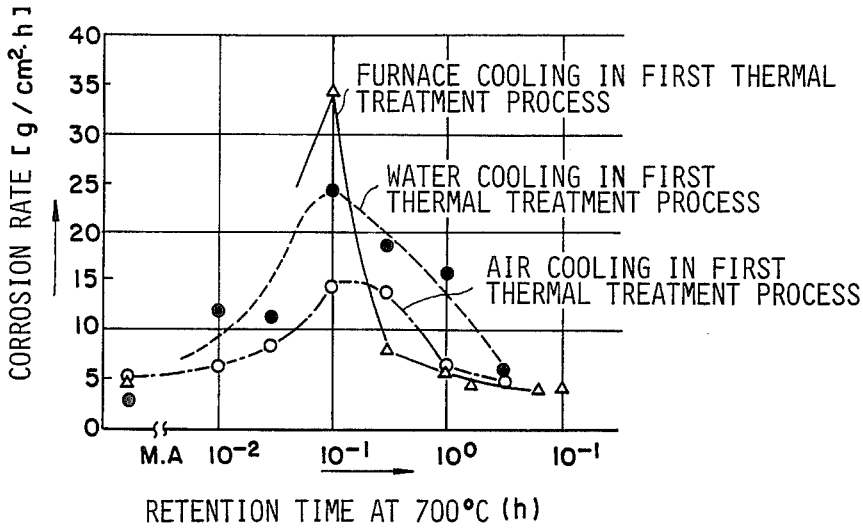
FIG. 3 is a diagram illustrating influences of a cooling rate of the first thermal treatment process and a temperature retaining time of the second thermal treatment process regarding the present invention upon the crystal boundary etching resistance.

After retained at a temperature of T° C. to (T+100)° C. for a period of 30 minutes in the first thermal treatment process, specimens were heated and retained at a temperature of 700° C. and were air cooled, and they were then immersed in a boiling solution of 65% $HNO_3$ and 0.2 g of $Cr^{6+}$/liter for a period of 24 hours. Obtained results of crystal boundary etching resistance tests are exhibited in FIG. 3 below. As the same drawing indicates, the sensitization range in the second thermal treatment process varies with the cooling rate in the first thermal treatment process, and it has been found that any case gets into the sensitization recovery range within 100 hours.

In Table 3, results of a variety of tests for the specimens in Table 2 are summarized. According to the results, it can be understood that the method of the present invention permits providing the nickel based alloy having the remarkably improved crystal boundary etching resistance, pitting corrosion resistance, mechanical properties and alkali stress corrosion cracking resistance, in contrast with the conventional methods.

As described in detail in the foregoing, the method for the thermal treatment of the nickel based alloy according to the present invention can noticeably improve the crystal boundary etching resistance, pitting corrosion resistance, mechanical properties and stress corrosion cracking resistance, therefore this method is most suitable for the thermal treatment for materials which will be subjected to a high-temperature and high-pressure water of 200° to 400° C., for example, materials for a container for giving off vapor in a nuclear reactor and materials for a cooling system in the nuclear reactor.

TABLE 2

| | Chemical components of specimens (%) | | | | | | | | | | | |
|---|---|---|---|---|---|---|---|---|---|---|---|---|
| | C | Si | Mn | P | S | Ni | Cr | Ti | Al | Fe | B | N |
| Alloy 1 | 0.013 | 0.24 | 0.18 | 0.013 | 0.001 | 61.16 | 28.82 | 0.31 | 0.30 | 8.98 | 0.0026 | — |
| Alloy 2 | 0.017 | 0.26 | 0.33 | 0.008 | 0.002 | 59.35 | 30.30 | 0.25 | 0.15 | 8.80 | 0.0002 | 0.0196 |
| Alloy 3 | 0.023 | 0.36 | 0.33 | 0.002 | 0.003 | 60.87 | 30.05 | 0.26 | 0.25 | Bal | 0.003 or less | — |
| Alloy 4 | 0.034 | 0.33 | 0.33 | 0.002 | 0.003 | 60.75 | 29.96 | 0.26 | 0.27 | Bal | 0.003 or less | — |

TABLE 3

Influence of thermal treatment conditions upon crystal boundary etching resistance, stress corrosion cracking resistance, pitting corrosion resistance and mechanical properties of nickel based alloy

| Thermal Treatment | | Crystal Boundary Etching Resistance | | | Stress Corrosion Cracking Resistance | | | Pitting Corrosion Resistance | Mechanical Properties | | |
|---|---|---|---|---|---|---|---|---|---|---|---|
| First Thermal Treatment | Second Thermal Treatment | Fluorine Nitrate Test | $Cr^{6+}$ Addition Nitric Acid Test | EPR*1 | Neutral*2 | Acid*3 | Alkali*4 | Acid | Tensile Strength | 0.2% Yield Point | Hardness |
| Conventional Method | | | | | | | | | | | |
| 900° C. (T −130° C.) | — | 0 | 0 | 0 | 0 | 0 | x | Δ | 0 | x | x |
| 900° C. (T −130° C.) | 700° C. × 15 h | 0 | 0 | 0 | 0 | 0 | Δ | 0 | 0 | x | x |

TABLE 3-continued

Influence of thermal treatment conditions upon crystal boundary etching resistance, stress corrosion cracking resistance, pitting corrosion resistance and mechanical properties of nickel based alloy

| Thermal Treatment | | Crystal Boundary Etching Resistance | | | Stress Corrosion Cracking Resistance | | | Pitting Corrosion Resistance | Mechanical Properties | | |
|---|---|---|---|---|---|---|---|---|---|---|---|
| First Thermal Treatment | Second Thermal Treatment | Fluorine Nitrate Test | $Cr^{6+}$ Addition Nitric Acid Test | EPR*1 | Neutral*2 | Acid*3 | Alkali*4 | Acid | Tensile Strength | 0.2% Yield Point | Hardness |
| Reference Method | | | | | | | | | | | |
| 1100° C. (T −70° C.) | — | 0 | 0 | 0 | 0 | 0 | x | x | 0 | 0 | 0 |
| Present Invention | | | | | | | | | | | |
| 1100° C. (T −70° C.) | 700° C. × 15 h | | | | 0 | 0 | | | 0 | 0 | 0 |

: Very good
0: Good
Δ: Slightly good
x: Bad
*1Electro Potentiokinetic Reactivation: A method for estimating the crystal boundary etching resistance in a potential-current diagram from a peak current generated when a voltage which has been raised up to a level of a passive state range is dropped.
*2Retention was made at 360° C. for 1000 hours in a running degassed water.
*3Retention was made at 300° C. for 1000 in a high-temperature non-degassed water including 500 ppm of Cl.
*4Retention was made at 325° C. for 1000 hours in a degassed water including 10% of NaOH.
*5Retention was made at 288° C. for 1000 hours in a high-temperature non-degassed water including 100 ppm of Cl.

*(1) Electro Potentiokinetic Reactivation: A method for estimating the crystal boundary etching resistance in a potential-current diagram from a peak current generated when a voltage which has been raised up to a level of a passive state range is dropped.

*(2) Retention was made at 360° C. for 1000 hours in a running degassed water.

*(3) Retention was made at 300° C. for 1000 hours in a high-temperature non-degassed water including 500 ppm of Cl.

*(4) Retention was made at 325° C. for 1000 hours in a degassed water including 10% of NaOH.

*(5) Retention was made at 288° C. for 1000 hours in a high-temperature non-degassed water including 100 ppm of Cl.

What is claimed is:

1. A method for the thermal treatment of a nickel based alloy comprising the steps of:

(1) heating in a furnace an alloy consisting essentially of
58 to 64% by weight Ni,
25 to 35% by weight Cr,
not more than 0.003% by weight boron,
0.012 to 0.035% by weight C,
not more than 1% by weight Mn,
not more than 0.5% by weight Si,
not more than 0.015% by weight P,
not more than 0.015% by weight S,
with the remainder being Fe
at a temperature from T° C. to (T+100)° C. to thoroughly solubilize the carbide in the alloy and cooling the thus treated alloy at a cooling rate which is at least as fast as the cooling rate of the furnace in which the alloy was heated; and (2) heating the thus cooled alloy in the sensitization recovery range as defined in FIG. 2 at a temperature in the range from 600° to 750° C. for a period of from 0.1 to 100 hours and then cooling the thus treated alloy at a cooling rate which is at least as fast as the cooling rate of the furnace in which the alloy was heated.

2. The method of claim 1 wherein the time period of the heating of step (1) is from 1 to 120 minutes.

* * * * *